United States Patent [19]

Richter

[11] Patent Number: 4,870,909

[45] Date of Patent: Oct. 3, 1989

[54] SEALING DEVICE FOR SEALING OPENINGS IN SHELTERS

[75] Inventor: Klaus Richter, Berlin, Fed. Rep. of Germany

[73] Assignee: ABS Allgemeiner Brandschutz, G.u.M., Fed. Rep. of Germany

[21] Appl. No.: 125,219

[22] Filed: Nov. 25, 1987

[30] Foreign Application Priority Data

Nov. 27, 1986 [DE] Fed. Rep. of Germany ..... 3640466
Nov. 27, 1986 [DE] Fed. Rep. of Germany ..... 3640467

[51] Int. Cl.[4] ..... E06B 3/34; E05G 1/04

[52] U.S. Cl. ..... 109/59 T; 109/73; 109/75

[58] Field of Search ..... 109/59 R, 59 T, 65, 109/69, 70, 73, 75, 77; 49/339, 340, 345

[56] References Cited

U.S. PATENT DOCUMENTS 2,771,042 11/1956 Deaton ..... 109/64
3,371,628 3/1968 McClellan ..... 109/59
3,735,714 5/1973 Shoop ..... 109/59
4,510,714 4/1985 Kasper et al. ..... 49/340
4,669,394 6/1987 Fogleman et al. ..... 109/59 T

*Primary Examiner*—Neill R. Wilson
*Attorney, Agent, or Firm*—Arnold S. Weintraub

[57] ABSTRACT

A sealing device for sealing an opening in a shelter (1) against heat action. The walls (9) or ceiling of the shelter comprise several mechanically self-supporting, good thermally insulating layers. The device includes at least one element closing or sealing the opening and a support structure for supporting the element. A locking system and an operating device operating the locking system operate on the element. The element, as seen from the interior of the shelter can be pivoted to the outside and its construction corresponds to that of the wall. The element is held on support arms by the support structure which, from a load standpoint, is independent of the walls in the shelter interior. The locking system is located on the inside of the sealing element and the operating device is accessible both from the inside and from the outside.

19 Claims, 5 Drawing Sheets

SEALING DEVICE FOR SEALING OPENINGS IN SHELTERS

BACKGROUND OF THE INVENTION

1. Field of the Invention:

The invention relates to a sealing device for sealing openings in protected areas or shelters.

2. Prior Art:

There is a need to store important documents, data carriers, chemicals and the like in such a way that they are not destroyed in the case of an undesired action from the outside, e.g. increased heat effects in the case of a fire. DE-OS 30 10 031 discloses a shelter for storing data carriers in such a way that the latter are completely protected and whose wall comprises a plurality of thermally insulating material layers. In such shelters, existing openings such as for doors and air conditioning systems must be sealed in such a way that they do not bring about a transfer of the harmful effect, e.g. heat, in the case of a fire. Although said publication discloses a sealing element for the air conditioning opening and a door for the passage opening, no details are given of the construction thereof and it can only be seen that there are two parallel door elements.

European patent application No. 0 0023621 discloses a fireproof steel cabinet, safe or the like, in which there is a double wall, which is filled with a chemical solid having a melting point of approximately 30° to 40° C. Under high temperature influences, as a result of the fire or the like, in the vicinity of the steel cabinet, the thermal energy acting thereon is consumed for a long time for overcoming the melting point of the chemical solid. This cabinet has two doors, each of which is operated from the outside, the inner door having a double-walled construction and is filled with the chemical solid. The outer door has two chambers containing, on the one hand, glass wool and, on the other, concrete. The door stops are positioned externally on the wall, so that the entire load of the doors is held by the wall. In the case of a fire, there are very high external temperatures which act on the walls, so that warping can occur. This is increased by the load of the doors and the stops, also, suffer as a result of the deformation, so that the door no longer tightly closes, which contributes to increasing the temperature in the inner area.

The problem to which the present invention is directed is to provide a sealing device for sealing openings in shelters which, even in the case of high temperatures and mechanical stresses acting from the outside, retains a sealing action for shielding the inner area against external effects and which can be opened and closed both from the inside and from the outside.

SUMMARY OF THE INVENTION

The present invention provides a support structure which is independent of the wall from the load standpoint and which is positioned in front of the wall in the interior of the shelter, the opening only being closed by an outwardly pivotable wall element when considered from the inner area and which is held on support arms on the support structure. The wall is no longer under the load of the weight of the wall element and the stops or the support structure with its support arms are in the cold area, so that no deformations or the like can occur which could influence the sealing action. Due to the arrangement of the support structure, only a single outwardly pivotable wall element is required, which can be opened and closed easily and permits a controlled automatic closing, particularly in the case of a fire.

According to the invention, the wall element locking system is located on its inside, the operating device operating the locking system being accessible both from the inside and from the outside of the enclosed area. Therefore, the locking system can be arranged in the cold or interior area. As a result of the inventive construction, no double door is required, so that handling is much easier.

According to an advantageous embodiment, the support arm is not only mounted in a rotary manner on a spar or transom of the support structure, but, also, on a connecting member connected to the door, so that several degrees of freedom are available for swinging or pivoting out the wall element. A control lever is, also, provided for the controlled swinging or pivoting out. The control lever is also articulated in rotary manner on the transom and on the connecting member. Advantageously the articulation points of the control lever and the support arm are arranged on the transom and on the connecting member, in such a way that the pivoting paths of the articulation points on the connecting member intersect about the articulation points on the transom. Consequently, a controlled opening or closing is possible in such a way that, on opening the wall element, moving out, initially, takes place from the opening parallel to the wall and only then does the pivoting of the wall element take place. Such a movement sequence also prevents any impediment by the wall in the case of a thick door.

The reliable, fireproof separation of the operating device is achieved in that it has a shaft passing through the wall of the wall element and is interrupted within the wall so as to form two partial shafts, which are connected by a connecting element which is released in the case of a fire. Thus, the locking system can be operated by means of a shaft which is of the through type in the normal operating state and which is interrupted under heat action, so that no heat conduction can take place. In the case of a fire, advantageously, a material which can expand at high temperatures is disposed around the operating device. The expansible material is chosen in such a way that during expansion it gives off water vapor, which also serves to cool the partial shafts. If the material is positioned in the outwardly directed area, it is particularly effective during the first to second hour of the fire. When providing material between the partial shafts, there is a cooling between the second and twenty-second hours, after the start of the fire.

According to a preferred embodiment, the actuating device includes an electromagnet with a metal plate by means of which the locking bolts of the locking system can be kept in the retracted state after they have been completely unlocked. Thus, the locking bolts do not impede the movement of the door, i.e. they do not rub against the door filling, so that the amorphous fireproofing material is not damaged.

The wall element is provided with a drive unit having an electric motor and is, preferably, located in the cold area. The drive unit automatically opens or closes the wall element after unlocking the locking bolts. Thus, apart from the simplification of the handling of the wall element in the normal operating state, it is possible for automatic closure of the wall element if a fire occurs, the control signal for closing purposes being given by a smoke or temperature sensor or the like connected to the drive unit.

The drive unit preferably has two interconnected levers, one of which is fixed to the wall element and the other is in operative connection with the electric motor of the drive unit in such a way that the angle between the levers tends towards zero on moving the wall element into the closed state. As a result of the resulting sinusoidal movement, the motor has the greatest power in the approximately closed state of the wall element and, consequently, correctly draws the latter into the soffit, the metal plate being simultaneously released by the electromagnet and the locking bolts being extended.

According to the present invention the drive unit has a pinion driven by the electric motor and a ratchet wheel located on a shaft which meshes with the pinion, the movement of the shaft bringing about the movement of the wall element. In case of an emergency, the wall element can be opened from the inner area by hand to release the engagement with the ratchet wheel, the pinion being displaceably arranged, displacement being brought about by means of a linkage.

In order that nobody can be jammed during the automatic closure of the door by the drive unit, a slip clutch is provided.

Normally the operating device for opening or closing the locking system is operated by means of two handwheels, each being positioned at a respective end of the shaft of the operating device. If the wall element is only to be opened by an authorized person, an electric motor can be provided, in place of the handwheels, which rotates the shaft of the operating device, the electric motor being controlled by a coding device or the like.

An embodiment of the invention is described in greater detail hereinafter relative to the drawings wherein show:

DESCRIPTION OF THE PREFERRED EMBODIMENTS

Figure 1:
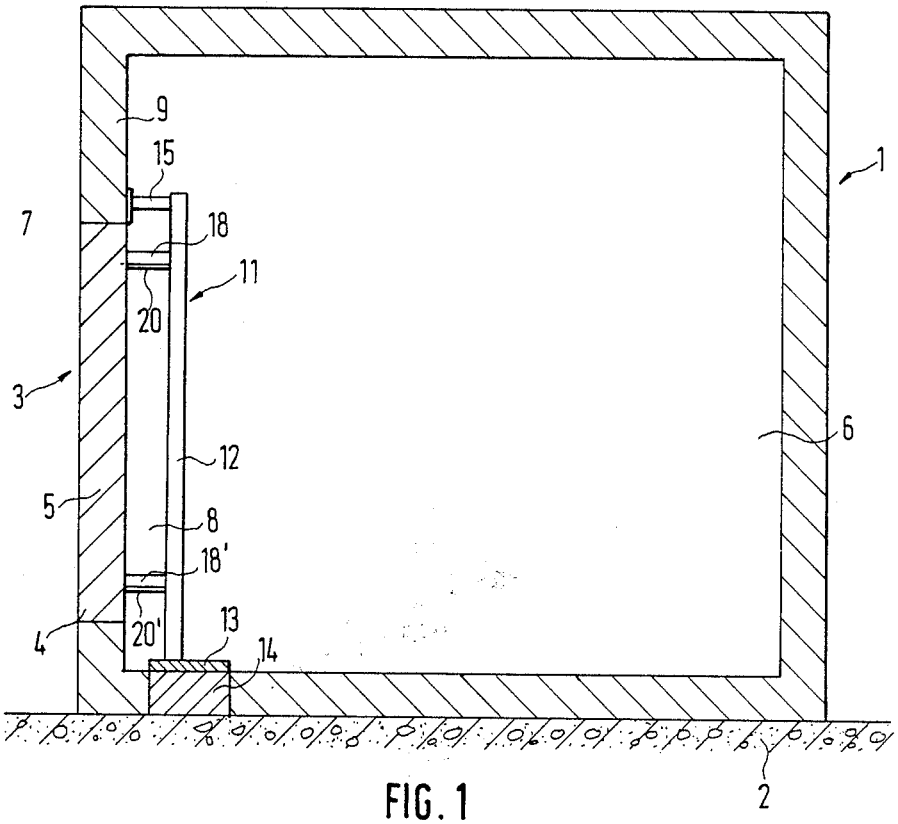
FIG. 1 is a diagrammatic vertical section through the shelter with the support structure in the case of the wall element being closed.

FIG. 1 shows a section through a protected area or shelter 1, which is generally placed on a concrete floor 2 in a building. Shelter 1 serves to securely store data carriers, chemicals, important documents or the like. In case of a fire or other similar situation, the shelter 1 can be entered by a passage 4 sealable or closable by a sealing or closing device 3. The walls 5 of shelter 1 comprise an inner and an outer metal envelope, between which is placed a thermal insulation material, such as fire protection plates or the like. Additionally a support mechanism is provided within the layers of walls, the layers thereof being self-supported and not being mechanically interconnected.

Sealing device 3 includes one wall element 5 which can be swung or pivoted out and whose construction corresponds to that of the other walls of the shelter, i.e. it, also, comprises an inner and an outer metal envelope, between which are positioned thermally insulating material layers. In order to ensure a good sealing between the inner area 6 of shelter 1 and the outer area 7, wall element 5 and the soffit 10 (FIG. 2) bounding the opening 8 in wall 9 are grooved a plurality of times.

Figure 2:
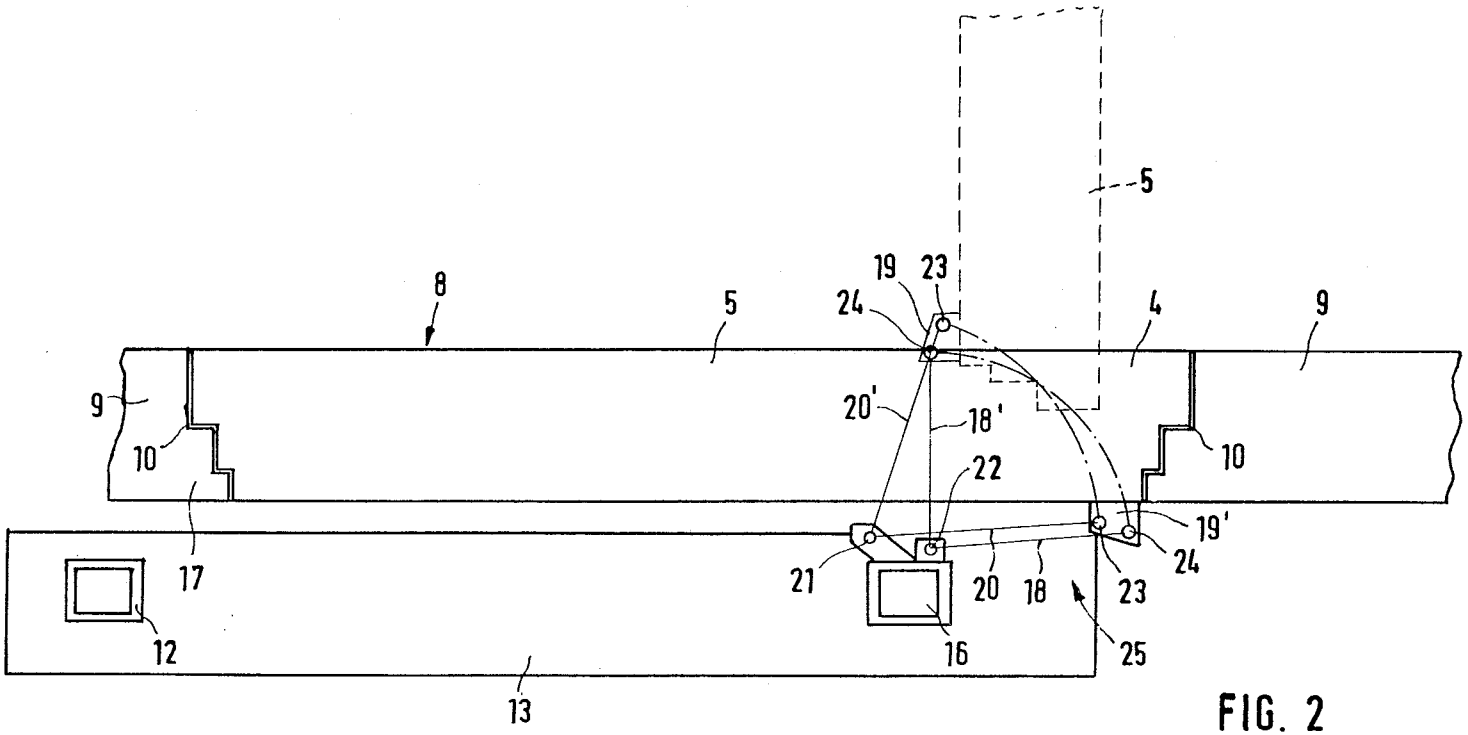
FIG. 2 is a partial section through the wall and the wall element parallel to the floor of the shelter.
Figure 3:
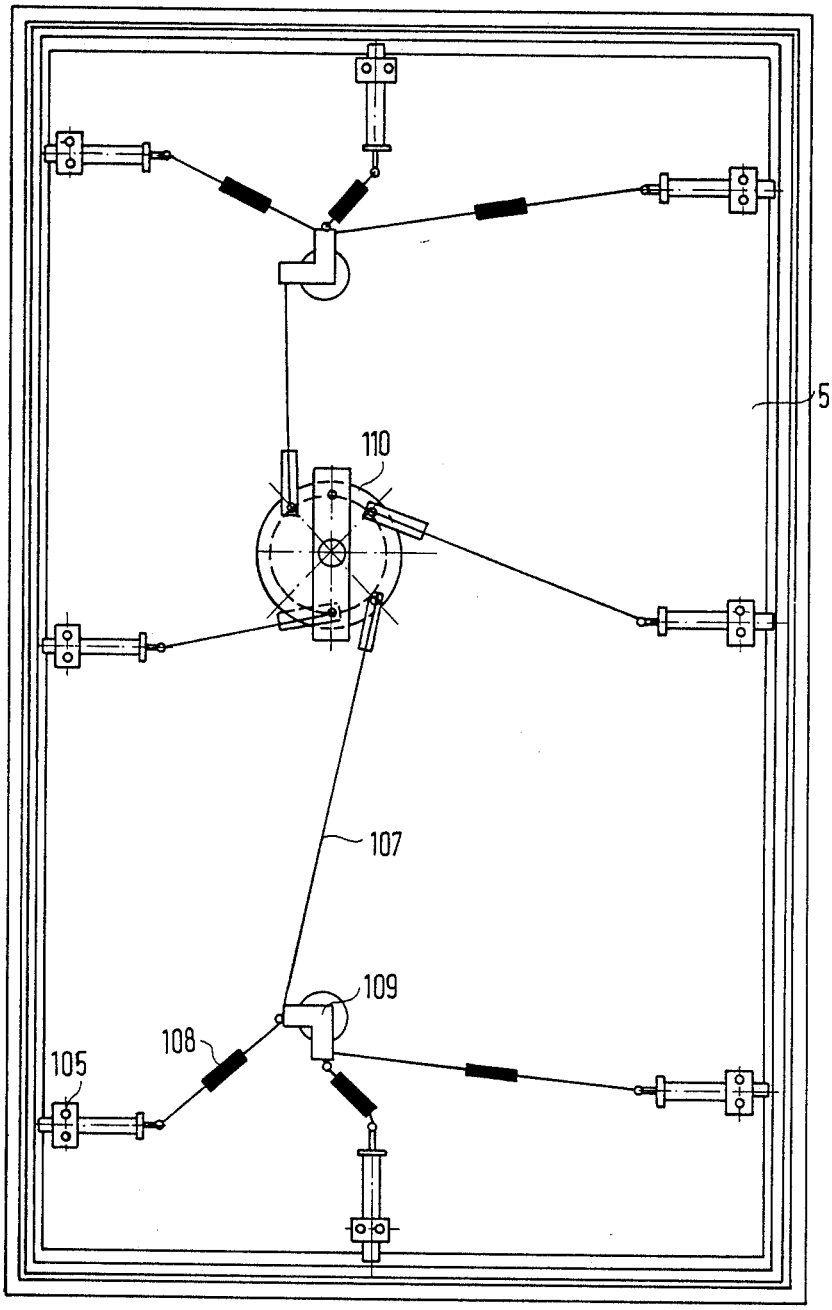
FIG. 3 is a plan view of the locking system of the wall element as seen from the interior of the shelter.

As shown in FIGS. 1 and 2 the inner area 6 contains a support structure 11 for the swinging wall or sealing element 5 where the support structure 11, in the present embodiment, has a frame 12 formed from square pipes and a base plate 13 connected thereto. The support structure 11 is located in front of wall 9 and from a load standpoint is independent of the wall, the concrete floor 2 taking up the load via baseplate 13 and an understructure 14. However, frame 12 can be supported by means of support elements 15 on wall 9.

As best seen in FIGS. 1 and 2, a spar or transom 16 of frame 12, to which is fixed wall element 5, is located in front of an opening 4, the width of the opening must be larger than the width of the effective passage 8, where the passage is bounded by transom 16 on one side and on the other side by a wall part 17 surrounding opening 4. Two support arms 18, 18' are rotatably articulated to transom 16. The facing ends of each support arm 18, 18' receives a connecting member 19, 19', respectively, which is pivotable about the end of support arm 18, 18' and which is fixed to wall element 5. Adjacent to the support arms 18, 18' are control levers 20, 20' which are, also, articulated by first ends to transom 16 and by second ends to connecting members 19, 19'.

On extending the wall elements, control levers 20, 20' at the start of the movement of the wall element 5 prevent a pivoting of the wall element 5 and ensure a movement thereof parallel to opening 4 until the pivoting movement is released. This is not possible at the outset due to the thickness of the wall element and the wall. When the wall element 5 is open, support arms 18, 18' are approximately perpendicular to the opening, i.e. they are at an angle of approximately 90°, if an imaginary line from articulation points 21, 22 on transom 16 parallel to the width of passage 8 defines an angle of 0°. With the support arms 18, 18' in this position, the angle between the imaginary line and the control levers 20, 20' is greater than 90°. For closing wall element 5 the support arms 18, 18' and control levers 20, 20' are pivoted about a pivoting path which is in the angular range of from 90° to 180°. The pivoting paths of articulation points 23, 24 of the ends of the control levers 20, 20' and the support arms 18, 18' on the connecting members 19, 19' intersect about the particular articulation point 21, 22 on transom 16. In the direction of passage 8, the articulation points 21, 23 of control levers 20, 20' are laterally displaced relative to the articulation points 22, 24 of support arms 18, 18' with the wall element 5 in the closed state. Preferably control levers 20, 20' are longer than support arms 18, 18'. If wall element 5 is closed, then the articulation points 22, 24 of support arms 18, 18' are displaced towards inner area 6 with respect to the corresponding articulation points 21, 23 of control levers 20, 20'.

As stated hereinbefore, the opening 4 in wall 9 is wider than effective passage 8, so that a small open area 25 remains alongside transom 16, where, in the closed state of the wall element 5, the opening 4 is closed by the latter by the latter towards the outside in the same way as the support arms and the control levers. From the interior, the open area 25 is preferably covered by a covering or the like. The sealing device is described in this embodiment for the purpose of sealing passages through which it is possible to walk. However, sealing devices for air conditioning openings and the like can be constructed in the same way.

Figure 4:
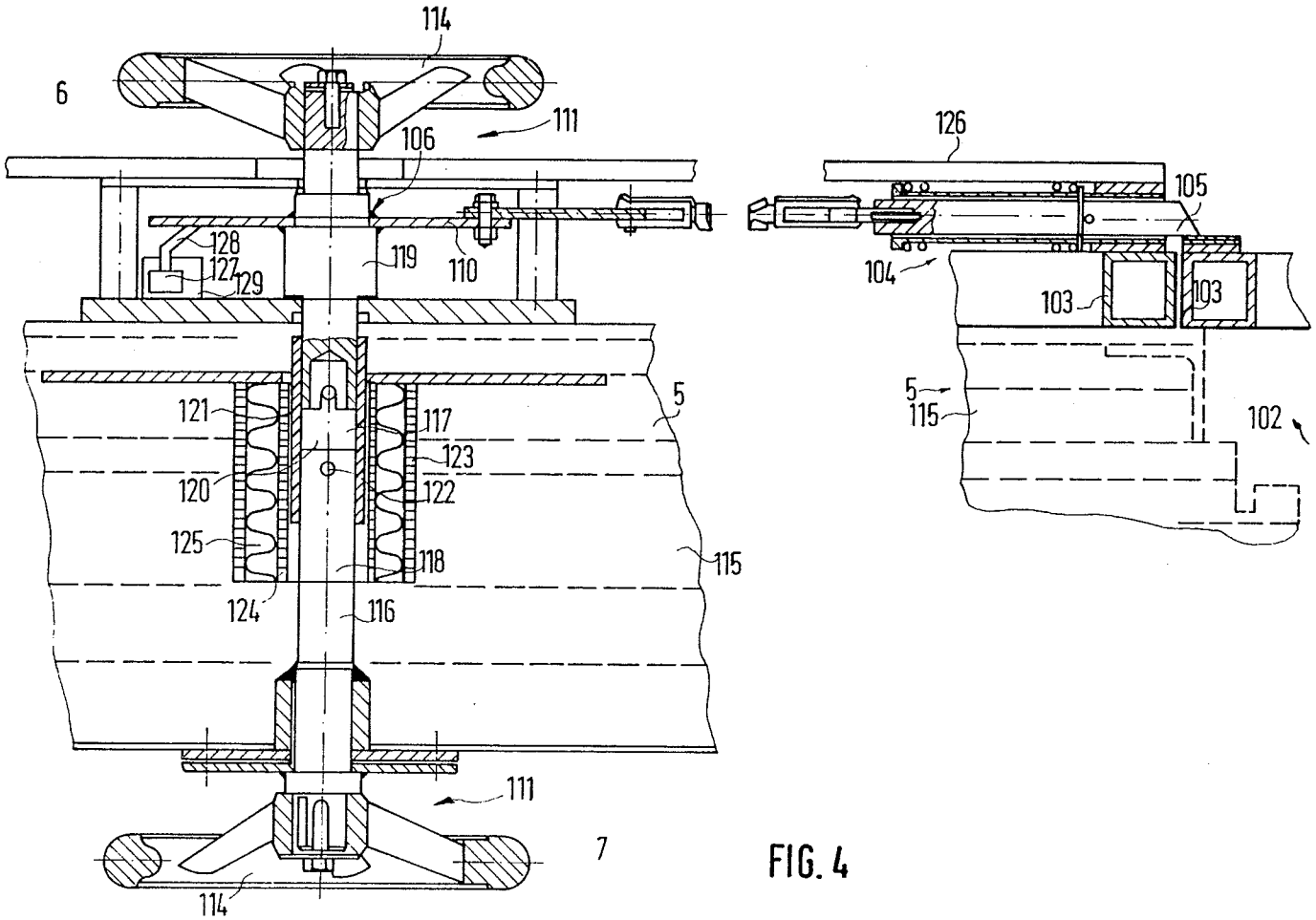
FIG. 4 is a section through the operating device for the wall element.
Figure 5:
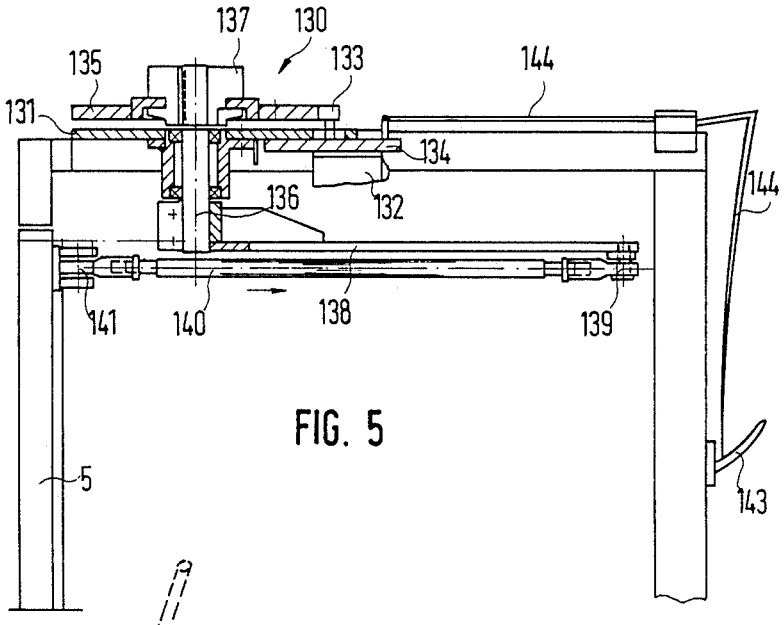
FIG. 5 is a section through the drive unit of the wall element.

As best shown in FIGS. 4 and 5 wall element 5 and soffit 102 have a frame formed from square pipes 103 which face the interior. On the circumference of wall element 5 are arranged a plurality of locking bolts 105 forming the locking system 104 and which in the locked state at least partly overlap the soffit frame 103. Locking bolts 105 are operated from a fulcrum 106, the rotary movement being transferred to the locking bolts 105 via rods 107, ball end joints 108 and angle pieces 109 mounted in a rotary manner. Rods 107 are connected on a disk 110 forming the fulcrum 106.

The operating device 111 for the locking system can be operated both from the inner area 6 and the outer area 7 by means of handwheels 114. Handwheels 114 are located on a shaft 116 passing through the wall 115 of wall element 5 and the shaft having has a fire protection interruption 117. Shaft 116 comprises two partial shafts 118 and 119, whose ends face one another in a spaced manner so as to form a free area 120. On the opposing or facing shaft ends is press fitted a plastic envelope 121, which bridges the free area or space 120 and which is connected to the shaft ends by means of pins 122. Envelope 121 transfers the rotation of partial shaft 118 to partial shaft 119 and vice versa. A tubular grating or perforated plate 124 is arranged around the free space 120 and the ends of partial shafts 118, 119 and is in turn surrounded by a second, larger-diameter grating 123, so that between the perforated plates is formed a space, which is filled with an expansible material 125. The expansible material may comprise an alkali metal silicate, such as, calcium silicate, sodium silicate or the like mixed with water glass. In case of a fire, the envelope 121 melts as a result of the heat transfer from the outer area via partial shaft 118 and at approximately 190° C. The expansible material 125 starts to expand and slowly fills the free space 120, water vapor being given off which additionally cools the shaft ends. Thus, any heat transfer from partial shaft 118 to partial shaft 119 is substantially avoided.

In case of a fire, there is a maximum temperature of 1000° after one hour, the temperature slowly decreasing over a period of 23 hours and ultimately reaches a relatively constant value. During this time there must be a maximum temperature rise of 30° in the inner area. If, as described, the expansible material is positioned in the interior of the wall element, then the cooling of the operating device is only effective in the period between the 2nd to the 23rd hours after the start of the fire. However, the expansible material can also be placed in the outwardly directed area of the wall element around the operating device, i.e. the shaft. In this case, there is also a cooling during the 1st hour after the start of the fire.

As a result of the above-described construction, it is possible to provide an operating device which passes through the wall of wall element 5 and can be operated from either side, whereby nevertheless a separation takes place in the case of a fire and the interior is not heated via shaft 116.

If the operating device 111 is locked by a lock from the outside, precautions must be taken to ensure that the wall element can also be opened from the inside if someone is unintentionally locked in. Thus, on the side facing the partial shaft 119, envelope 121 is provided with a transverse slot (not shown), whose length corresponds to the rotary path for unlocking the locking bolts 105.

As shown in FIG. 4, the rotation of shaft 116 is transferred to disk 110 and the locking bolts 105 are operated by means of linkage 107, 108 and 109. Unlocking takes place counter to the tension of a spring 126 located on the locking bolts 105. A metal plate 127 is fixed, by means of an arm 128, to disk 110 and cooperates with an electromagnet 129 located on the inside of the door and forms an electro-switch. If the locking bolts are in their completely retracted state as a result of the rotation of shaft 116 and disk 110, metal plate 127 is in contact with electromagnet 129 and is held thereon. Thus, the locking bolts 105 remain in the retracted, unlocked state, so that the bolts 105 cannot rub against the soffit on opening the wall element. Thus, on the one hand the movement of wall element 5 is not impeded and on the other the amorphous fireproofing material is not damaged by a rubbing movement. Thus, during the entire period during which the wall element 5 is open, the locking bolts remain unlocked. On closing wall element 5, its end position is scanned by limit switches (not shown), which give a signal to electromagnet 129, which is then de-energized and releases metal plate 127. Thus, the locking bolts 105 are released and springs 126 press the locking bolts 105 into their locking position, so that the wall element 5 is additionally secured.

In place of or in addition to the handwheels 114, it is possible to provide electric motors which drive shaft 116 for unlocking the locking bolts 105.

Referring now to FIG. 5, in order to be able to automatically open and close wall element 5, a drive unit 130 is provided which is arranged in the inner area 6, i.e. in the cold area, above wall element 5. Drive unit 130 has its own electric supply, so that it remains operable if the electric power supply in the outer area has failed. The drive unit is located on a bearing block 131 and has an electric motor 132, which drives a pinion 133, electric motor 132 and pinion 133 being disposed on a displaceable slide 134. The pinion meshes with a ratchet wheel 135 mounted on a shaft 136, a slip clutch 137 being interposed. At the end of the shaft 136 is fixed a first lever 138, which is connected by means of a joint 139 to a second lever 140. The latter is fixed by means of a further joint 141 to the wall element 5.

For the opening wall element 5, drive unit 130 receives a signal from electromagnet 129, which, with metal plate 127, acts as a switch on contact thereof, and electric motor 132, then, drives pinion 133 and via ratchet wheel 135 and shaft 136 the first and second levers 138, 140. The limit switches (not shown) indicate the desired open position, so that drive unit 130 receives a control signal from the limit switches when wall element 5 is in the desired open position. Thus, for removing the wall element from the end position the drive unit is operated again and closes wall element 5. In addition, there are temperature sensors or smoke indicators, which supply a signal to the drive unit in the case of a fire, so that the door is automatically closed. In order to ensure that no one is jammed between soffit 102 and wall element 5, slip clutch 137 is provided, which stops the movement of wall element 5 in the case of corresponding resistance.

Figure 6:
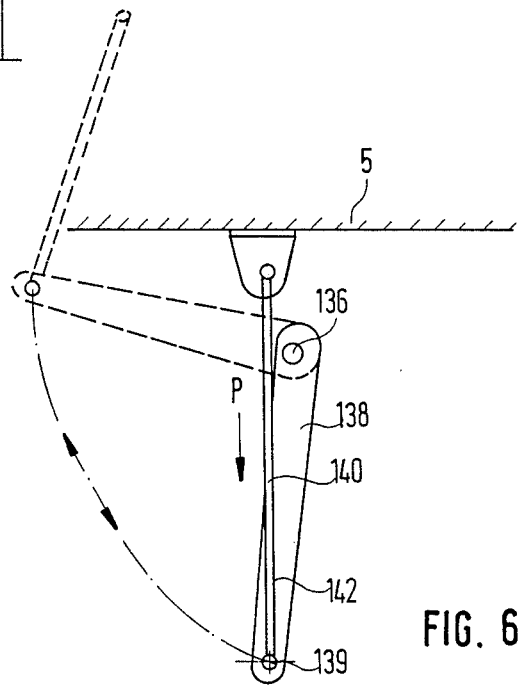
FIG. 6 is a plan view of the drive unit lever arrangement.

FIG. 6 shows the movement sequence of the first and second levers 138, 140, which are positioned in such a way that the angle 142 between them tends towards zero in the direction of the closed position of wall element 5. As a result of the intimated sinusoidal movement in the almost closed state of wall element 5, the electric motor transfers, via levers 138, 140, the highest power P to the wall element 5, so that it is drawn into the soffit 102. Simultaneously the electromagnet 129 is deenergized by the signals supplied by the limit switches, so that the locking bolts 105 are released and the door is locked.

Even if a drive unit is provided, the wall element must be openable from the inside. Thus, alongside wall element 5 there is a lever 143, whose movement, when operated by means of connecting rods 144, is transferred to the displaceable slide 134. The slide 134, together with electric motor 132 and pinion 133, can be retracted, so that the pinion 133 can be disengaged from the ratchet wheel 135. Thus, the closing member can be manually opened independently of drive unit 130, so that even in the case of a power supply failure of drive unit 130, it is still possible to open wall element 5.

In the described embodiment all the fittings, levers and mounting brackets necessary for the operation of the wall element, with the exception of the outwardly directed partial shaft 118 with the handwheel 119, are located in inner area 6, i.e. in the cold area, the wall element opening direction being towards the outside.

Having, thus, described the invention what is claimed is:

1. A sealing device for sealing an opening in a walled shelter against heat action, comprising:

(a) at least one sealing element for normally closing the opening in the shelter, the sealing element being complimentarily configured to that of the opening and constructed similarly to that of the shelter;

(b) a support structure for supporting the sealing element;

(c) a locking system disposed within the sealing element, the support structure including a pair of support arms for supporting the sealing element independent of the walls of the shelter, the support structure being positioned within the interior of the shelter;

(d) an operating device for operating the locking system, the operating device being accessible from within the shelter and exteriorly thereof;

(e) means for outwardly pivoting the sealing element;

(f) an understructure mounted within the bottom of the shelter;

(g) an outer floor on which the shelter is disposed; and wherein the support structure transfers the load of the sealing element to the understructure.

2. The sealing device according to claim 1 which further comprises:

(a) a transom mounted on the support structure, the transom being associated with two support arms;

(b) means for pivotably connecting one end of each support arm to the transom;

(c) a pair of connecting members fixed to the sealing element, each connecting member being associated with a support arm for rotatably connecting the associated support arm to the sealing element; and (d) a pair of control levers, each control lever being pivotally connected at one end to the transom and at the other end to the connecting member.

3. The sealing device according to claim 2 wherein each control lever and associated support arm are so articulated to the transom and associated connecting member that the pivot paths of the articulation points of the ends of each control lever and support arm on the connecting member about the particular articulation point on the associated transom intersect each other.

4. The sealing device according to claim 2 wherein each transom is positioned in the vicinity of the opening of the shelter, such that each limits the passage width of the opening thereby forming a passage within the shelter such that in the closed state, the sealing element overlaps each transom, each support arm and each control lever.

5. The sealing device according to claim 3 characterized in that the pivot paths of each support arm and control lever from the opened to the closed state of the sealing element are in an angular range of 90° to 180° when an imaginary line from the articulation points, parallel to the width of the passage in the shelter, defines an angle of 0° in the completely opened state, the sealing element and support arms assume an angle of 90°.

6. The sealing device according to claim 4 wherein: when the sealing element is in the closed state the articulation points of each control lever are laterally displaced towards the passage with respect to the particular articulation points of the support arms, and the articulation points of the support arms are displaced towards the interior of the shelter with respect to the corresponding articulation points of the control levers.

7. The sealing device according to claim 2 wherein the control levers are longer than the support arms.

8. The sealing device according to claim 1 wherein the locking system has a plurality of locking bolts positioned in the edge region of the sealing element and are connected to the operating device by pulling and sliding members.

9. The sealing device according to claim 1 wherein the operating device comprises: (a) a shaft passing through the wall of the sealing element, the shaft being interrupted within the interior of the sealing element so as to form two spaced partial shafts, and (b) a connecting element interconnecting the opposed ends of the partial shafts, the connecting element being broken in the case of a fire.

10. The sealing device according to claim 1 which further comprises: a material which is expansible at high temperatures and which has a cooling action, the material at least partially surrounding the two partial shafts of the operating device.

11. The sealing device according to claim 9 which further comprises: a disk fixed to the shaft of the operating device on the inside of sealing element, the pulling and sliding members being anchored to the disk.

12. The sealing device according to claim 9 which further comprises: an electromagnet and a magnetic plate one or the other being fixed to the operating device and the sealing element, respectively, the electromagnet and plate cooperating with the sealing element, when open, to keep the locking bolts in the retracted state and releases them when wall element is in its closed position.

13. The sealing device according to claim 12 which further comprises: a drive unit having an electric motor which closes the sealing element or opens it to the outside following the unlocking of the locking system.

14. The sealing device according to claim 13 wherein the electromagnet and the magnetic plate form a switch, the drive unit being connected to the switch.

15. The sealing device according to claim 13 which further comprises: an independent power supply for the drive unit.

16. The sealing device according to claim 13 wherein the drive unit is arranged in the interior of the shelter.

17. The sealing device according to claim 13 wherein the drive unit further comprises:

(a) a pinion driven by the electric motor;

(b) a ratchet wheel;

(c) a rotatable shaft, the ratchet wheel being mounted on the shaft and meshing with the pinion, the drive unit being fixed to a bearing block.

18. The sealing device according to claim 17 which further comprises: (a) means for releasing the pinion from the ratchet wheel, comprising: (1) a displaceable slide upon which the pinion is mounted, (2) a plurality of connecting rods connected to the slide and (3) means for moving the connecting rods to move the slide to disengage the pinion from the ratchet wheel.

19. The sealing device according to claim 9 wherein the connecting element is an envelope having a transverse slot on the side facing the exterior partial shaft slot corresponding to the rotary path for unlocking the locking.

* * * * *

UNITED STATES PATENT OFFICE

CERTIFICATE OF CORRECTION

Patent No. 4,870,909 Dated October 3, 1989

Inventor(s) Klaus Richter

It is certified that error appears in the above-identified patent and that said Letters Patent is hereby corrected as shown below:

Assignee: ABS Allgemeiner Brandschutz
G.u.M. Breivogel GMBH
Fed. Rep. of Germany

Signed and Sealed this

Twenty-fifth Day of June, 1991

*Attest:*

HARRY F. MANBECK, JR.

*Attesting Officer*

*Commissioner of Patents and Trademarks*